US007121338B2

(12) United States Patent
van Zuilekom et al.

(10) Patent No.: US 7,121,338 B2
(45) Date of Patent: Oct. 17, 2006

(54) PROBE ISOLATION SEAL PAD

(75) Inventors: Anthony Herman van Zuilekom, Houston, TX (US); Chi-Huang Chang, Sugar Land, TX (US)

(73) Assignee: Halliburton Energy Services, INC, Houston, TX (US)

( * ) Notice: Subject to any disclaimer, the term of this patent is extended or adjusted under 35 U.S.C. 154(b) by 145 days.

(21) Appl. No.: 10/765,622

(22) Filed: Jan. 27, 2004

(65) Prior Publication Data

US 2005/0161218 A1 Jul. 28, 2005

(51) Int. Cl.
*E21B 49/10* (2006.01)

(52) U.S. Cl. ..... 166/264; 166/100

(58) Field of Classification Search ..... 166/264, 166/100; 73/152.24, 152.26
See application file for complete search history.

(56) References Cited

U.S. PATENT DOCUMENTS

| | | | | |
|---|---|---|---|---|
| 3,173,485 | A * | 3/1965 | Bretzke, Jr. | 166/100 |
| 3,324,712 | A | 6/1967 | Watson et al. | |
| 3,530,933 | A * | 9/1970 | Whitten | 166/100 |
| 3,565,119 | A | 2/1971 | Pierpont, Jr. et al. | |
| 3,565,169 | A * | 2/1971 | Bell | 166/100 |
| 3,599,719 | A * | 8/1971 | Brown | 166/297 |
| 3,658,127 | A | 4/1972 | Cochran et al. | |
| 3,659,647 | A | 5/1972 | Brown | |
| 3,673,864 | A | 7/1972 | Cubberly, Jr. | |
| 3,776,561 | A | 12/1973 | Haney | |
| 3,811,321 | A | 5/1974 | Urbanosky | |
| 3,813,936 | A | 6/1974 | Urbanosky et al. | |
| 3,858,445 | A | 1/1975 | Urbanosky | |
| 3,859,850 | A | 1/1975 | Whitten et al. | |
| 3,859,851 | A | 1/1975 | Urbanosky | |
| 3,864,970 | A | 2/1975 | Bell | |
| 3,868,826 | A | 3/1975 | Landers | |
| 3,924,463 | A | 12/1975 | Urbanosky | |
| 3,934,468 | A | 1/1976 | Brieger | |
| 3,952,588 | A | 4/1976 | Whitten | |
| 4,003,581 | A | 1/1977 | Hutchison | |
| 4,046,011 | A | 9/1977 | Olsen | |
| 4,053,354 | A | 10/1977 | Kitsnik | |

(Continued)

FOREIGN PATENT DOCUMENTS

| | | |
|---|---|---|
| CA | 1108985 | 9/1981 |

(Continued)

OTHER PUBLICATIONS

G. D. Phelps et al.;"The Effect of Filtrate Invasion and Formation Wettability on Repeat Formation Tester Measurements"; 1984 European Petroleum Conference; Oct. 25-28, 1984; pp. 59-68 with Figures 1-12; SPE 12962; Society of Pertroleum Engineers of AIME; London, England.

(Continued)

*Primary Examiner*—William Neuder
(74) *Attorney, Agent, or Firm*—Conley Rose, PC

(57) ABSTRACT

A seal pad comprising a base plate and an expandable material engaged with the base plate. The expandable material comprises an outer surface where a portion of the outer surface is used to form a seal against a borehole wall. A portion of the outer surface of the expandable material is expanded during the sealing against the borehole wall. The seal pad also comprises a retainer for controlling the expansion of the expandable material. The retainer controls the expansion of the expandable material by engaging at least a portion of the outer surface of the expandable material. Thus when the seal is formed by expanding the expandable material, at least a portion of the expandable material is contained by the retainer.

43 Claims, 9 Drawing Sheets

U.S. PATENT DOCUMENTS 4,146,092 A 3/1979 Upton
4,161,319 A 7/1979 Stocking
4,210,018 A 7/1980 Brieger
4,224,987 A 9/1980 Allen
4,234,197 A 11/1980 Amancharla
4,246,782 A 1/1981 Hallmark
4,248,081 A 2/1981 Hallmark
4,252,195 A 2/1981 Fredd
4,270,385 A 6/1981 Hallmark
4,287,946 A 9/1981 Brieger
4,288,082 A 9/1981 Setterberg, Jr.
4,289,200 A 9/1981 Fisher, Jr.
4,292,842 A 10/1981 Hallmark
4,302,018 A 11/1981 Harvey et al.
4,323,256 A 4/1982 Miyagishima et al.
4,339,948 A 7/1982 Hallmark
4,416,152 A 11/1983 Wilson
4,434,653 A 3/1984 Montgomery
4,441,721 A 4/1984 Harris et al.
4,444,400 A 4/1984 Norman
4,452,463 A 6/1984 Buckner
4,482,086 A 11/1984 Wagner et al.
4,500,095 A 2/1985 Schisler et al.
4,507,957 A 4/1985 Montgomery et al.
4,512,399 A 4/1985 Gano et al.
4,513,612 A 4/1985 Shalek
4,535,843 A 8/1985 Jageler
4,579,314 A 4/1986 Schaeper et al.
4,589,485 A 5/1986 Wray
4,593,560 A 6/1986 Purfurst
4,610,158 A 9/1986 Lawton, Jr.
4,635,717 A 1/1987 Jageler
4,638,860 A 1/1987 Magee, Jr. et al.
4,745,802 A 5/1988 Purfurst
4,753,444 A 6/1988 Jackson et al.
4,765,404 A 8/1988 Bailey et al.
4,843,878 A 7/1989 Purfurst et al.
4,845,982 A 7/1989 Gilbert
4,860,580 A 8/1989 DuRocher
4,860,581 A 8/1989 Zimmerman et al.
4,862,967 A 9/1989 Harris
4,879,900 A 11/1989 Gilbert
4,884,439 A 12/1989 Baird
4,890,487 A 1/1990 Dussan et al.
4,936,139 A 6/1990 Zimmerman et al.
4,941,350 A 7/1990 Schneider
4,951,749 A * 8/1990 Carroll ..... 166/264
5,056,595 A 10/1991 Desbrandes
5,095,745 A 3/1992 Desbrandes
5,101,907 A 4/1992 Schultz et al.
5,148,705 A 9/1992 Desbrandes
5,184,508 A 2/1993 Desbrandes
5,230,244 A 7/1993 Gilbert
5,231,874 A 8/1993 Gilbert
5,233,866 A 8/1993 Desbrandes
5,238,070 A 8/1993 Schultz et al.
5,249,461 A 10/1993 Ponder et al.
5,265,015 A 11/1993 Auzerais et al.
5,269,180 A 12/1993 Dave et al.
5,279,153 A 1/1994 Dussan et al.
5,303,775 A 4/1994 Michaels et al.
5,311,938 A 5/1994 Hendrickson et al.
5,318,117 A 6/1994 Echols, III et al.
5,329,811 A 7/1994 Schultz et al.
5,335,542 A 8/1994 Ramakrishnan et al.
5,377,755 A 1/1995 Michaels et al.
5,390,738 A 2/1995 Eslinger et al.
5,433,269 A 7/1995 Hendrickson
5,473,939 A 12/1995 Leder et al.
5,489,740 A 2/1996 Fletcher
5,549,159 A 8/1996 Shwe et al.
5,587,525 A 12/1996 Shwe et al.
5,602,334 A 2/1997 Proett et al.
5,622,223 A 4/1997 Vasquez
5,635,631 A 6/1997 Yesudas et al.
5,644,076 A 7/1997 Proett et al.
5,676,213 A 10/1997 Auzerais et al.
5,741,962 A 4/1998 Birchak et al.
5,743,333 A 4/1998 Willauer et al.
5,803,186 A 9/1998 Berger et al.
5,826,662 A 10/1998 Beck et al.
5,857,520 A 1/1999 Mullen et al.
5,934,374 A 8/1999 Hrametz et al.
5,961,123 A 10/1999 Ingram et al.
5,992,522 A 11/1999 Boyd et al.
6,007,067 A 12/1999 Hiorth
6,047,239 A 4/2000 Berger et al.
6,203,020 B1 3/2001 Mireles, Jr. et al.
6,230,798 B1 5/2001 Appleton
6,250,638 B1 6/2001 Youngquist
6,301,959 B1 10/2001 Hrametz et al.
6,557,640 B1 5/2003 Cook et al.
6,568,487 B1 5/2003 Meister et al.
6,658,930 B1 * 12/2003 Abbas ..... 73/152.26
2001/0035289 A1 11/2001 Runia
2002/0189339 A1 12/2002 Montalvo et al.
2003/0068599 A1 4/2003 Balfour et al.
2003/0098162 A1 5/2003 Cook
2004/0079909 A1 4/2004 Foster
2004/0173351 A1 * 9/2004 Fox et al. ..... 166/264
2005/0109538 A1 * 5/2005 Fisseler et al. ..... 175/20
2005/0155760 A1 * 7/2005 Hill et al. ..... 166/264

FOREIGN PATENT DOCUMENTS

CA 1167761 5/1984
CA 1182393 2/1985
CA 1212315 10/1986
CA 1280362 2/1991
CA 2096068 5/1993
CA 2185169 11/1993
CA 2185170 11/1993
CA 2103096 5/1994
CA 2204329 11/1997
CA 2215422 2/1999
CA 2318157 7/1999
CA 2389123 12/2002
CN 1356452 7/2002
EP 0 102 756 B1 12/1986
EP 0 250 107 B1 8/1992
EP 0 497 588 A1 8/1992
EP 0 599 422 A2 6/1994
EP 0 453 052 B1 3/1995
EP 0 453 051 B1 4/1995
FR 2 789 469 A1 2/2000
GB 1455955 11/1976
GB 2 204 922 A 11/1988
GB 2 226 908 A 7/1990
GB 2 283 516 A 5/1995
GB 2 312 908 A 11/1997
GB 2 328 229 A 2/1999
GB 2 333 310 A 7/1999
GB 2 350 635 A 12/2000
GB 2 378 719 A 2/2003
RU 2 097 555 C1 11/1997
RU 2 120 023 C1 10/1998
RU 2 128 278 C1 3/1999
RU 2 201 495 C2 3/2003
SU 306745 12/1972
SU 1735575 A1 5/1992
SU 1745894 A1 7/1992
SU 1763646 A1 9/1992
WO WO 81/02457 9/1981
WO WO 97/28348 8/1997

| | | |
|---|---|---|
| WO | WO 99/36663 | 7/1999 |
| WO | WO 00/43812 | 7/2000 |
| WO | WO 01/98630 A1 | 12/2001 |

OTHER PUBLICATIONS

Mark A. Proett et al.; "Supercharge Pressure Compensation Using a New Wireline Testing Method and Newly Developed Early Time Spherical Flow Model"; 1996 SPE Annual Technical Conference and Exhibition; Oct. 6-9, 1996; pp. 329-342; SPE 36524; Society of Petroleum Engineers, Inc.; Denver, Colorado, U.S.A.

W. B. Underhill et al.; "Model-Based Sticking Risk Assessment for Wireline Formation Testing Tools in the U.S. Gulf Coast"; 1998 SPE Annual Technical Conference and Exhibition; Sep. 27-30, 1998; pp. 79-89; SPE 48963; Society of Petroleum Engineers, Inc.; New Orleans, Louisiana, U.S.A.

R. Parkes et al.; "New Techniques in Wireline Formation Testing in Tight Reservoirs"; 1998 SPE Asia Pacific Oil & Gas Conference and Exhibition; Oct. 12-14, 1998; pp. 419-430; SPE 50128; Society of Petroleum Engineers, Inc.; Perth, Australia.

Amit K. Sakar et al.; "Adverse Effects of Poor Mudcake Quality: A Supercharging and Fluid Sampling Study"; SPE Reservoir Eval. & Eng. 3 (3); Jun. 2000; pp. 256-262; Society of Petroleum Engineers, Inc.; U.S.A.

Joel J. Hebert; "A Method for Planning and Performing a Pressure Survey to Achieve Desired Accuracy of Pressure Gradient"; ASME Engineering Technology Conference on Energy; Feb. 4-5, 2002; pp. 1-7; ETCE 2002/PROD-29117; American Society of Mechanical Engineers; Houston, Texas, U.S.A.

Hui Xu et al.; "In Situ Filtrate Flowrate Measurements With The Wireline Formation Tester"; SPWLA 34th Annual Logging Symposium; Jun. 13-16, 1993; pp. 1-15.

Margaret C. Waid et al.; "Interpretation of Wireline Formation Tester Pressure Response With Combined Flowline and Chamber Storage, Mud Supercharging and Mud Invasion Effects"; SPWLA 33rd Annual Logging Symposium; Jun. 14-17, 1992; pp. 1-25.

Halliburton MRILab® Service product brochure; pp. 124-125; 2003.

R. Desbrandes et al.; "A New Concept in Wireline Formation Testing: Extended Drawdown"; 13th CWLS Formation Evaluation Symp.; 1991; Calgary, Canada; pp. 1-25.

"Well Testing Using Wireline Methods"; Schlumberger S. East Asia Well Evaluation Conference; Oct. 1981; pp. 121-144.

L Moinard et al.; "Permeability Quantification from Borehole Stoneley Waves"; Proceedings Second Int. Pet. Conf. & Exbn.; pp. 547-558; PETROTECH-97; New Delhi, India.

A. A. Adeyemi-Bero et al.; "First Horizontal Well In The Shallow, Unconsolidated Sand and Viscous/Heavy Oil Reservoir of the Sapele Field, Nigeria"; 17th Annual Conference of the Society of Petroleum Engineers, Nigeria Council; 1993 pp. 71-84; SPENC 9308; Society of Petroleum Engineers, Nigeria Council; Warri, Nigeria.

Robert Desbrandes; "Wireline Formation Testing: A New Extended Drawdown Technique"; Petroleum Engineer International, May 1991; pp. 40-44; vol. 63, No. 5.

Neal G. Skinner et al.; "Formation-Pressure Test Tools: Pt. 2: Pressure Test Validity Shown By Comparing Field Tests And Simulations"; Oil & Gas Journal; Jan. 12, 1998; pp. 46-48.

R. Desbrandes et al.; "Wettability and Productivity Characterization of Low Permeability Gas Formations: Topical Report"; Gas Research Institute; Report GRI-92/0405; Dec. 1992.

L. Lin; "Reservoir Characterization with RFT Logs Using A Modes for Anisotropic Model"; SPWLA/China Petroleum Society Well Logging Joint Symposium; May 17-20, 1994; pp. 307-313; Xian, China.

R. Desbrandes et al.; "Wettability and Productivity Characterizations of Low Premeability Gas Formations: Annual Report"; Gas Research Institute; Report GRI-91/0135; Mar. 1991.

* cited by examiner

DETAIL D

SECTION B-B

SECTION A-A

PROBE ISOLATION SEAL PAD

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

During the drilling and completion of oil and gas wells, it is often necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties such as permeability, fluid type, fluid quality, formation pressure, and formation pressure gradient. Formation fluid samples are also taken for analysis of their hydrocarbon content. These tests determine whether commercial exploitation of the intersected formations is viable.

Formation testing tools are used to acquire a sample of fluid from a subterranean formation. This sample of fluid can then be analyzed to determine important information regarding the formation and the formation fluid contained within, such as pressure, permeability, and composition. The acquisition of accurate data from the wellbore is critical to the optimization of hydrocarbon wells. This wellbore data can be used to determine the location and quality of hydrocarbon reserves, whether the reserves can be produced through the wellbore, and for well control during drilling operations.

Formation testing tools may be used in conjunction with wireline logging operations or as a component of a logging-while-drilling (LWD) or measurement-while-drilling (MWD) package. In wireline logging operations, the drill string is removed from the wellbore and measurement tools are lowered into the wellbore using a heavy cable (wireline) that includes wires for providing power and control from the surface. In LWD and MWD operations, the measurement tools are integrated into the drill string and are ordinarily powered by batteries and controlled by either on-board or remote control systems.

To understand the mechanics of formation testing, it is important to first understand how hydrocarbons are stored in subterranean formations. Hydrocarbons are not typically located in large underground pools, but are instead found within very small holes, or pores, within certain types of rock. The ability of a formation to allow hydrocarbons to move between the pores, and consequently into a wellbore, is known as permeability. Similarly, the hydrocarbons contained within these formations are usually under pressure and it is important to determine the magnitude of that pressure in order to safely and efficiently produce the well.

During drilling operations, a wellbore is typically filled with a drilling fluid ("mud"), such as water, or a water-based or oil-based mud. The density of the drilling fluid can be increased by adding special solids that are suspended in the mud. Increasing the density of the drilling fluid increases the hydrostatic pressure that helps maintain the integrity of the wellbore and prevents unwanted formation fluids from entering the wellbore. The drilling fluid is continuously circulated during drilling operations. Over time, as some of the liquid portion of the mud flows into the formation, solids in the mud are deposited on the inner wall of the wellbore to form a mudcake.

The mudcake acts as a membrane between the wellbore, which is filled with drilling fluid, and the hydrocarbon formation. The mudcake also limits the migration of drilling fluids from the area of high hydrostatic pressure in the wellbore to the relatively low-pressure formation. Mudcakes typically range from about 0.25 to 0.5 inch thick, and polymeric mudcakes are often about 0.1 inch thick. The thickness of a mudcake is generally dependent on the time the borehole is exposed to drilling fluid. Thus, in MWD and LWD applications, where a section of the borehole may be very recently drilled, the mudcake may be thinner than in wireline applications.

Formation testing tools generally comprise an elongated tubular body divided into several tubular modules serving predetermined functions. A typical tool may have a hydraulic power module that converts electrical into hydraulic power; a telemetry module that provides electrical and data communication between the modules and an uphole control unit; one or more probe modules collecting samples of the formation fluids; a flow control module regulating the flow of formation and other fluids in and out of the tool; and a sample collection module that may contain various size chambers for storage of the collected fluid samples. The various modules of a tool can be arranged differently depending on the specific testing application, and may further include special testing modules, such as NMR measurement equipment. In certain applications the tool may be attached to a drill bit for logging-while-drilling (LWD) or measurement-while drilling (MWD) purposes. Examples of such multifunctional modular formation testing tools are described in U.S. Pat. Nos. 5,934,374; 5,826,662; 5,741,962; 4,936,139, and 4,860,581, the contents of which are hereby incorporated herein by reference for all purposes.

In formation testing equipment suitable for integration with a drill string during drilling operations, various devices or systems are provided for isolating a formation from the remainder of the wellbore, drawing fluid from the formation, and measuring physical properties of the fluid and the formation. However, MWD formation testing equipment is subject to harsh conditions in the wellbore during the drilling process that can damage and degrade the formation testing equipment before and during the testing process. These harsh conditions include vibration and torque from the drill bit, exposure to drilling mud, drilled cuttings, and formation fluids, hydraulic forces of the circulating drilling mud, and scraping of the formation testing equipment against the sides of the wellbore. Sensitive electronics and sensors must be robust enough to withstand the pressures and temperatures, and especially the extreme vibration and shock conditions of the drilling environment, yet maintain accuracy, repeatability, and reliability.

In one aspect of formation testing, the formation testing apparatus may include a probe assembly for engaging the borehole wall and acquiring formation fluid samples. The probe assembly may include an isolation pad to engage the borehole wall, or any mudcake accumulated thereon. The isolation pad seals against the mudcake and around a hollow probe, which places an internal cavity in fluid communication with the formation. This creates a fluid pathway that allows formation fluid to flow between the formation and the formation tester while isolated from the wellbore fluid.

In order to acquire a useful sample, the probe must stay isolated from the relative high pressure of the wellbore fluid. Therefore, the integrity of the seal that is formed by the isolation pad is critical to the performance of the tool. If the wellbore fluid is allowed to leak into the collected formation fluids, a non-representative sample will be obtained and the test will have to be repeated.

Examples of isolation pads and probes used in wireline formation testers include Halliburton's DT, SFTT, SFT4, and RDT. Isolation pads that are used with wireline formation testers are generally simple rubber pads affixed to the end of the extending sample probe. The rubber is normally affixed to a metallic plate that provides support to the rubber as well as a connection to the probe. These rubber pads are often molded to fit with the specific diameter hole in which they will be operating. These types of isolator pads are commonly molded to have a contacting surface that is cylindrical or spherical.

While conventional rubber pads are reasonably effective in some wireline operations, when a formation tester is used in a MWD or LWD application, they have not performed as desired. Failure of conventional rubber pads has also been a concern in wireline applications that may require the performance of a large number of formation pressure tests during a single run into the wellbore, especially in wells having particularly harsh operating conditions. In a MWD or LWD environment, the formation tester is integrated into the drill string and is thus subjected to the harsh downhole environment for a much longer period than in a wireline testing application. In addition, during drilling, the formation tester may be constantly rotated with the drill string and may contact the side of the wellbore and damage any exposed isolator pads. The pads may also be damaged during drilling by the drill cuttings that are being circulated through the wellbore by the drilling fluid.

The structure and operation of a generic formation tester are best explained by referring to FIG. 1. In a typical formation testing operation, a formation tester 100 is lowered to a desired depth within a wellbore 102. The wellbore 102 is filled with mud 104, and the wall of wellbore 102 is coated with a mudcake 106. Once formation tester 100 is at the desired depth, it is set in place by extending a pair of feet 108 and an isolation pad 110 to engage the mudcake 106. Isolation pad 110 seals against mudcake 106 and around hollow probe 112, which places internal cavity 119 in fluid communication with formation 122. This creates a fluid pathway that allows formation fluid to flow between formation 122 and formation tester 100 while isolated from wellbore fluid 104.

In order to acquire a useful sample, probe 112 must stay isolated from the relative high pressure of wellbore fluid 104. Therefore, the integrity of the seal that is formed by isolation pad 110 is critical to the performance of the tool. If wellbore fluid 104 is allowed to leak into the collected formation fluids, an non-representative sample will be obtained and the test will have to be repeated.

BRIEF DESCRIPTION OF THE DRAWINGS

For a more detailed description of the embodiments, reference will now be made to the following accompanying drawings.

DETAILED DESCRIPTION OF THE EMBODIMENTS

The drawings and the description below disclose specific embodiments of the present invention with the understanding that the embodiments are to be considered an exemplification of the principles of the invention, and are not intended to limit the invention to that illustrated and described. Further, it is to be fully recognized that the different teachings of the embodiments discussed below may be employed separately or in any suitable combination to produce desired results.

Various embodiments described provide for isolator pad assemblies especially suited for use in MWD or LWD applications but these assemblies may also be used in wireline logging or other applications. Reference is made to using the embodiments with a formation testing tool, but the embodiments may also find use in any tool that seeks to acquire a sample of formation fluid that is substantially free of wellbore fluid. It is to be fully recognized that the different teachings of the embodiments discussed below may be employed separately or in any suitable combination to produce desired results.

Figure 2:
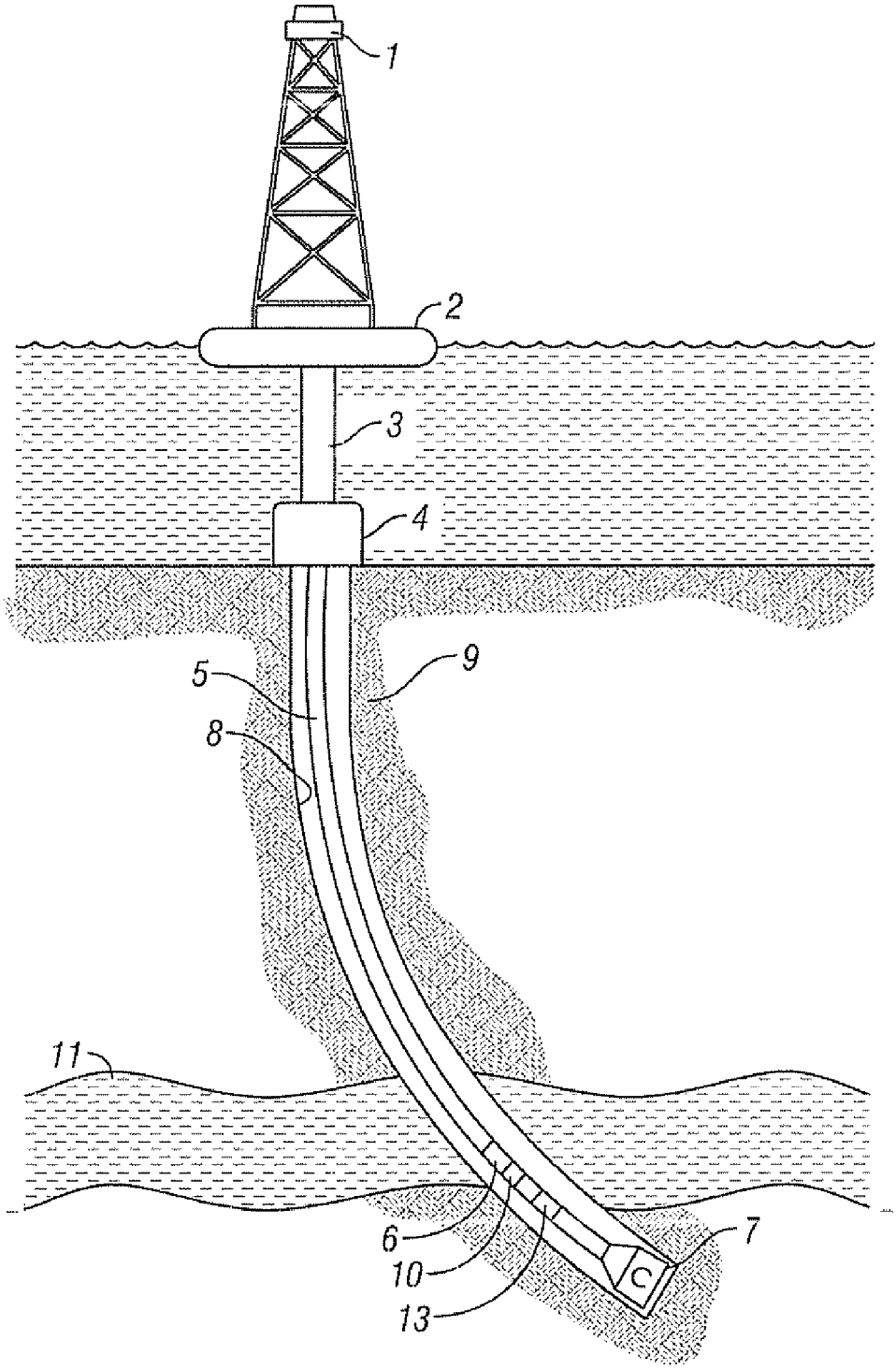
FIG. 2 is a schematic elevation view, partly in cross-section, of an embodiment of a formation tester apparatus disposed in a subterranean well.

Referring to FIG. 2, a formation tester tool 10 is shown as a part of bottom hole assembly 6 (BHA) that includes an MWD sub 13 and a drill bit 7 at its lower-most end. The BHA 6 is lowered from a drilling platform 2, such as a ship or other conventional platform, via a drill string 5. The drill string 5 is disposed through a riser 3 and a well head 4. Conventional drilling equipment (not shown) is supported within the derrick 1 and rotates the drill string 5 and the drill bit 7, causing the bit 7 to form a borehole 8 through the formation material 9. The borehole 8 penetrates subterranean zones or reservoirs, such as reservoir 11, that are believed to contain hydrocarbons in a commercially viable quantity. It should be understood that the formation tester 10 may be employed in other bottom hole assemblies and with other drilling apparatus in land-based drilling, as well as offshore drilling as shown in FIG. 2. In all instances, in addition to the formation tester 10, the bottom hole assembly 6 contains various conventional apparatus and systems, such as a down hole drill motor, mud pulse telemetry system, measurement-while-drilling sensors and systems, and others well known in the art. The drilling equipment used may be any suitable type, including a non-rotating composite tubing using a "mud motor" to power the drill bit rather than rotating drill string. The formation tester tool 10 may also be used on a wireline tool instead of a drill string.

Figure 1:
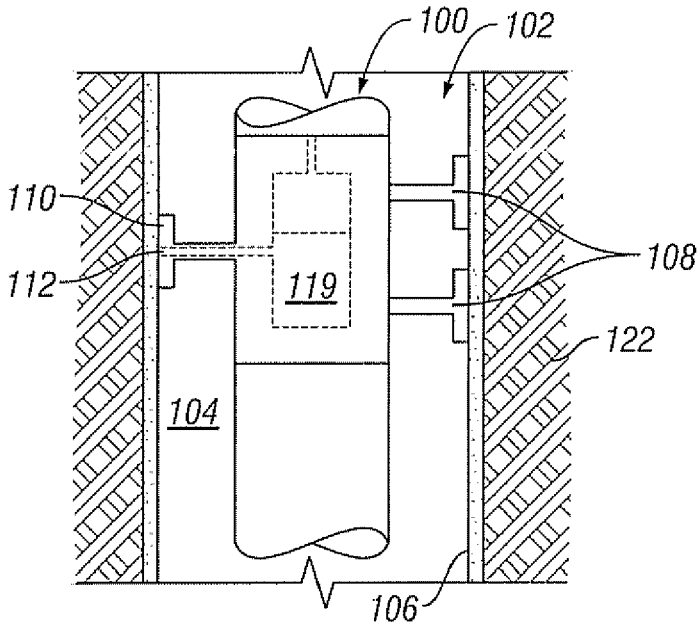
FIG. 1 (Prior Art)
FIG. 1 is a schematic representation of a prior art formation testing tool.
Figure 3:
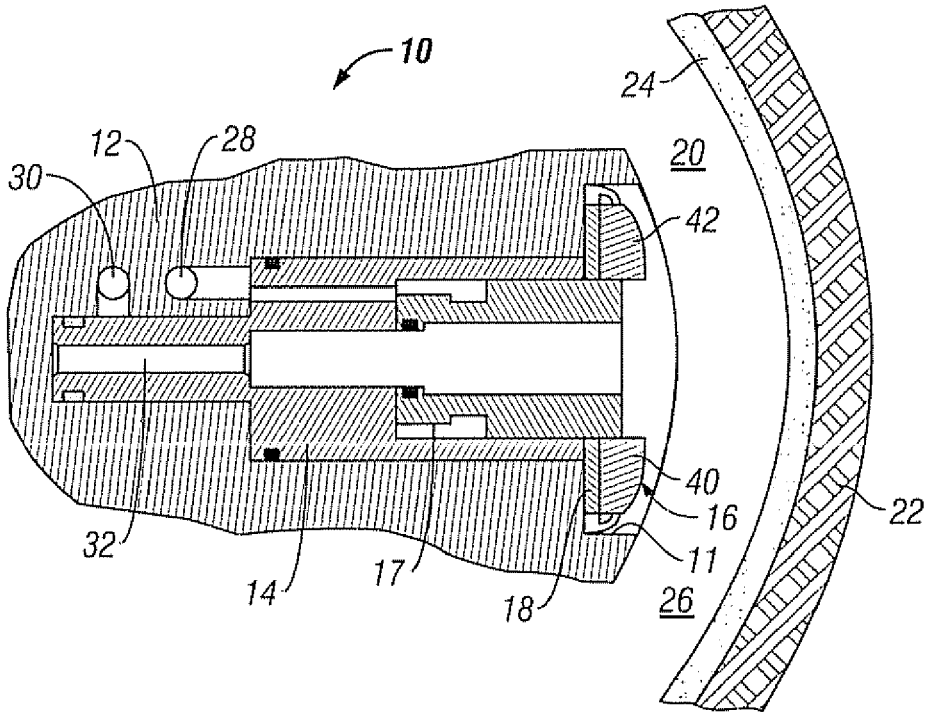
FIG. 3 is an embodiment of the extendable test probe assembly of the formation tester in a retracted position.

Referring now to FIG. 3, a cross-sectional view of an embodiment of an extendable test probe assembly 14 is shown in a retracted position and housed a tool body 12 of the formation tester 10. The extendable test probe assembly 14 generally comprises a seal pad 16 and an inner cylinder 17. The inner cylinder 17 is also known as a "snorkel" and includes a filter (not shown). The extendable test probe assembly 14 and tool body 12 are shown disposed in a wellbore 20 drilled into a formation 22. The wall of wellbore 20 is coated with a mudcake 24 that is formed by the circulation of wellbore fluid 26 through the wellbore 20.

Figure 4A:
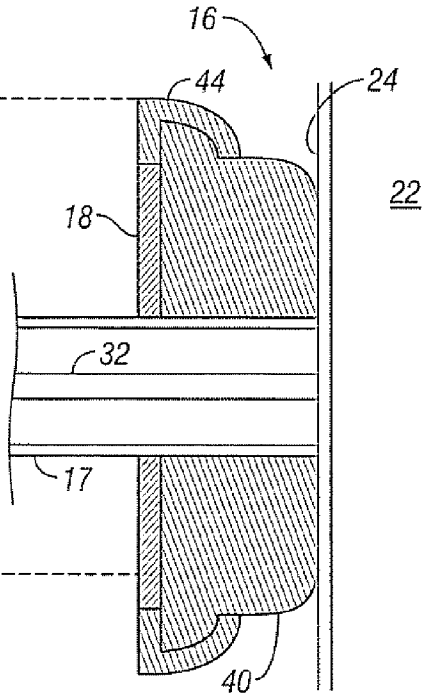
FIG. 4A is a detailed view of the extendable test probe assembly of FIG. 4.
Figure 4:
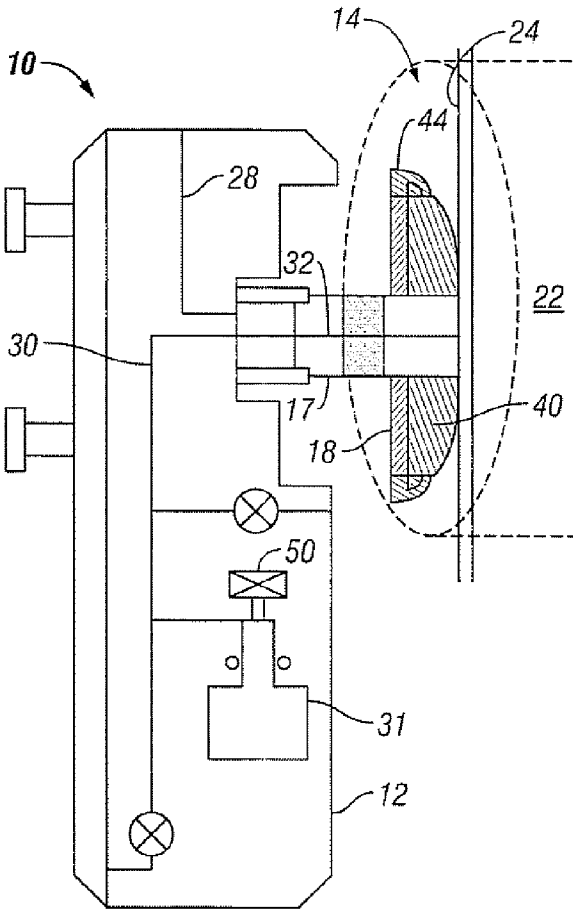
FIG. 4 is an elevation view of the formation tester with the extendable test probe assembly in an extended position.

Referring now to FIGS. 3, 4, and 4A, the tool body 12 has a substantially cylindrical body that is typical of tools used in downhole environments. The body 12 includes a hydraulic conduit 28 and a sample conduit 30 therethrough. The sample conduit 30 is in fluid communication with a fluid sample collection chamber 31. Likewise, the hydraulic conduit 28 is in fluid communication with a hydraulic power supply (not shown) that supplies hydraulic fluid to the conduit 28.

The extendable test probe assembly 14 is disposed within a corresponding recess 11 in the body 12. The outer surface of the cylinder 17 is in sealing engagement with the inner surface of the cavity in the tool body 12. Thus, the extendable test probe assembly 14 is sealed to and slidable relative to the tool body 12. The extendable test probe assembly 14 also comprises an axial central bore 32 through the cylinder 17. The central bore 32 is in fluid communication with the sample conduit 30.

As shown in FIGS. 4, 4A, 5–5D, and 6, the seal pad 16 is generally disc-shaped. If desired, the recess 11 in the tool body 12 is sized and configured to receive the pad 16 so that no portion of the extendable test probe assembly 14 extends beyond the outer surface of the tool body 12 when in the retracted position. The seal pad 16 also comprises a base plate 18 and an expandable material 40 engaged with the base plate 18. The expandable material 40 comprises an outer surface 42, a portion of which is engaged with the base plate 18 and a portion of which is used to form a seal against the wall of the borehole 20. The seal pad 16 also comprises a retainer 44 around the expandable material 40. The expandable material 40 and the base plate 18 also comprise a common bore 19 for housing the cylinder 17. The expandable material may be any material such as an elastomeric material, rubber, Teflon, or any other material suitable for forming a seal against a borehole wall. The expandable material 40 may also be engaged with the base plate 18 by epoxy or any other suitable means.

The drilling equipment drills the wellbore 20 until the desired formation 22 to be tested is reached. Drilling operations are then ceased to test the formation 22. The formation tester 10 operates by first extending the extendable test probe assembly 14 by applying fluid pressure through the hydraulic conduit 28 so that hydraulic pressure is applied between the extendable test probe assembly 14 and the body 12. The pressure advances the seal pad 16 toward the wall of the wellbore 20. The seal pad 16 is advanced through the mudcake 24 until the expandable material 40 contacts the formation 22. As the seal pad 16 extends, the expandable material 40 compresses against the formation 22, forming a seal.

Figure 8:
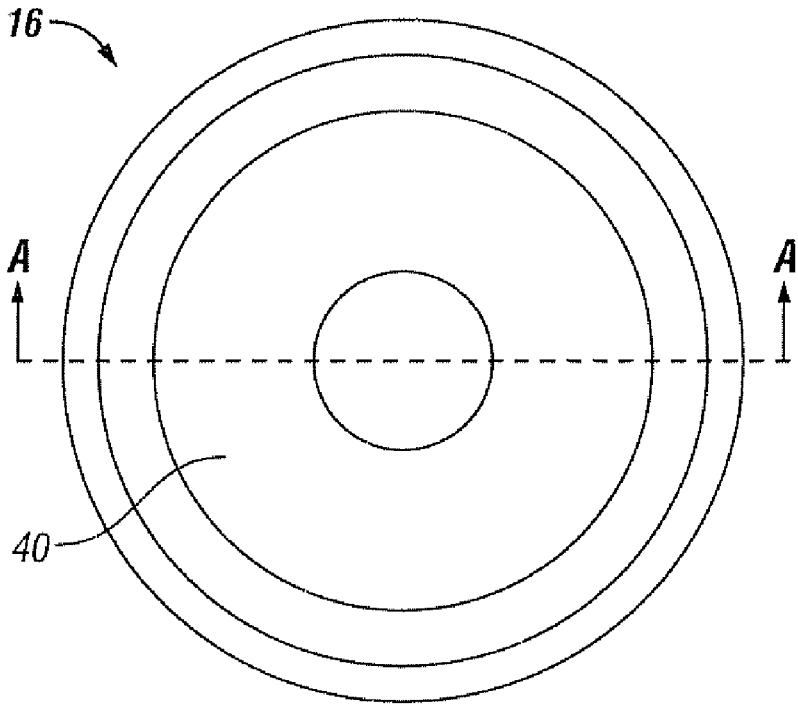
FIG. 8 is a top view of an alternative seal pad of the extendable probe assembly of FIG. 4.
Figure 8B:
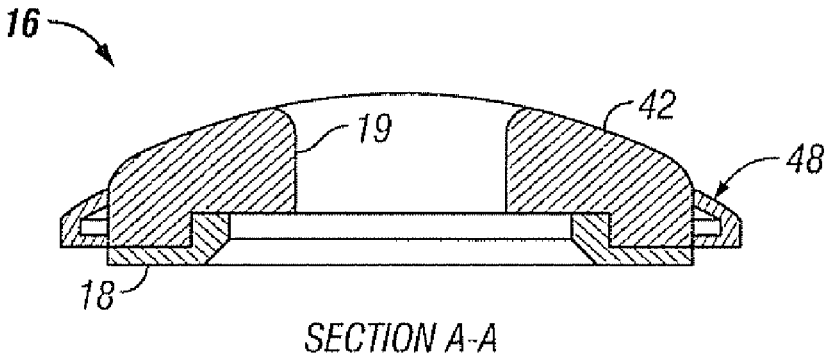
FIG. 8B is a cross-section view of the plane A—A of the seal pad shown in FIG. 8.

As the expandable material compresses against the formation 22, at least a portion of the expandable material 40 expands. The expansion occurs generally in the lateral direction relative to the direction of extension of the extendable test probe assembly 14, but may also occur in other directions. As the expandable material 40 expands, the retainer 44 controls the expansion of the expandable material 40 around the perimeter of the expandable material 40. In the embodiment shown in FIGS. 5–5D, the retainer 44 retains the expandable material with a surface 46 around a portion of the perimeter of the expandable material 40, as best shown in cross-section view B—B of FIG. 5A. The retainer 44 also retains the expandable material 40 with an expansion cavity 48, as best shown in cross-section views A—A of FIG. 5B and detail view "D" of FIG. 5D. Alternatively, as best illustrated in FIGS. 8 and 8B, the retainer 44 retains the expandable material with a surface 46 around the entire perimeter of the expandable material in a lateral plane of expansion of the expandable material when sealed against the borehole wall. As illustrated in FIG. 8B, the retainer also retains the expandable material 40 with an expansion cavity 48. As the expandable material 40 expands when forming the seal with the wall of the borehole 20, the expandable material engages the surface 46 and also fills in the cavity 48 as shown in FIGS. 4 and 4A. Thus, the retainer 44 controls the expansion of the expandable material 40 by engaging at least a portion of the outer surface of the expandable material when sealed against the borehole wall. The retainer 44 shown in FIGS. 3–6 controls the expansion of the expandable material generally in the lateral direction to the direction of extension of the extendable test probe assembly 14. However, the retainer 44 may also be used to control expansion of the extendable material 44 in other directions as well.

Figure 5:
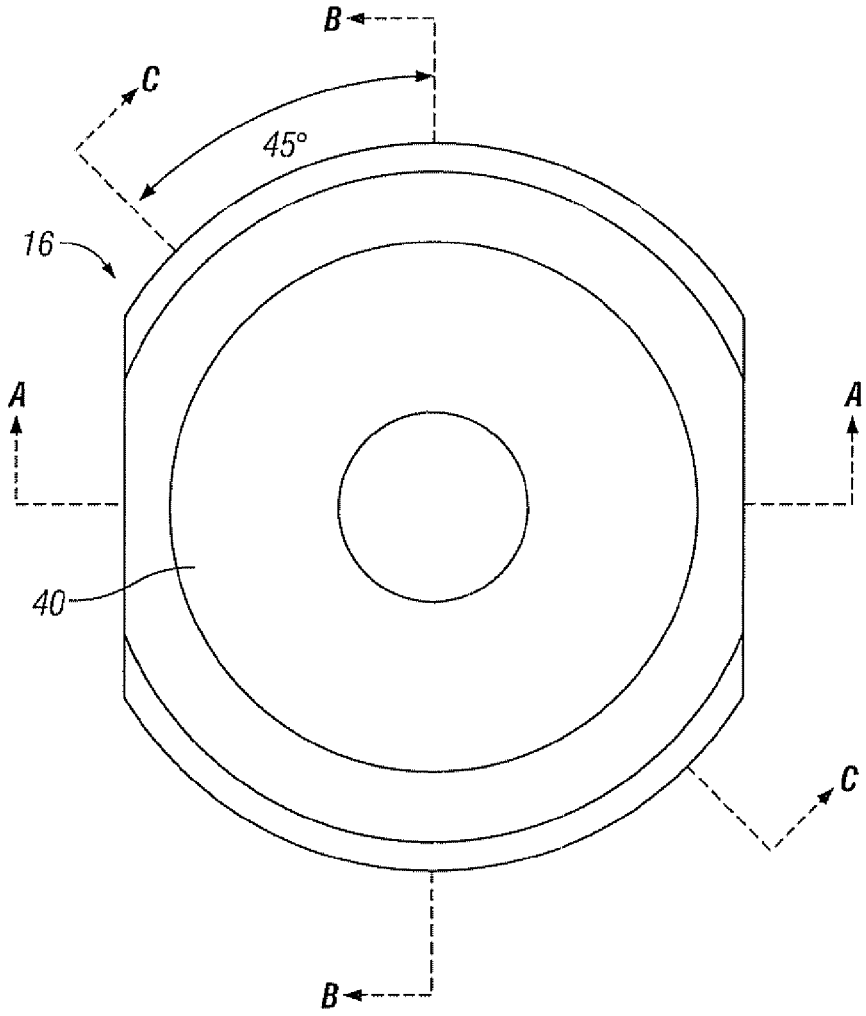
FIG. 5 is a top view of the seal pad of the extendable test probe assembly of FIG. 4.
Figure 5A:
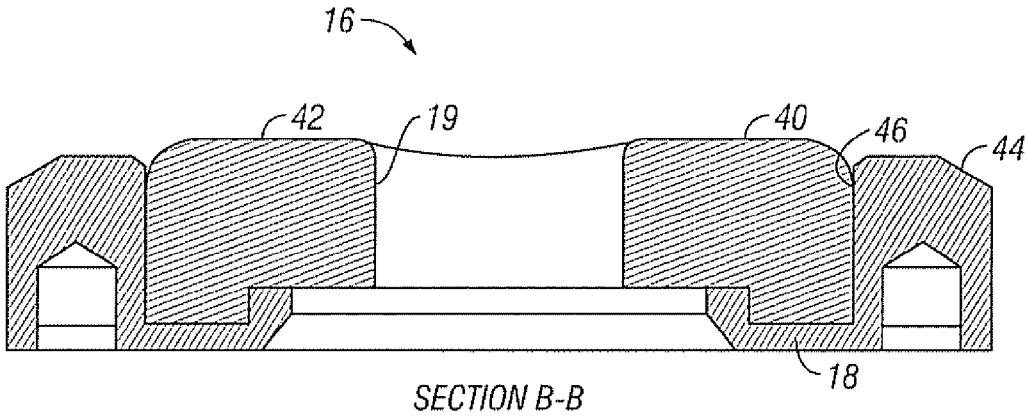
FIG. 5A is a cross-section view of plane B—B of the seal pad shown in FIG. 5.
Figure 5B:
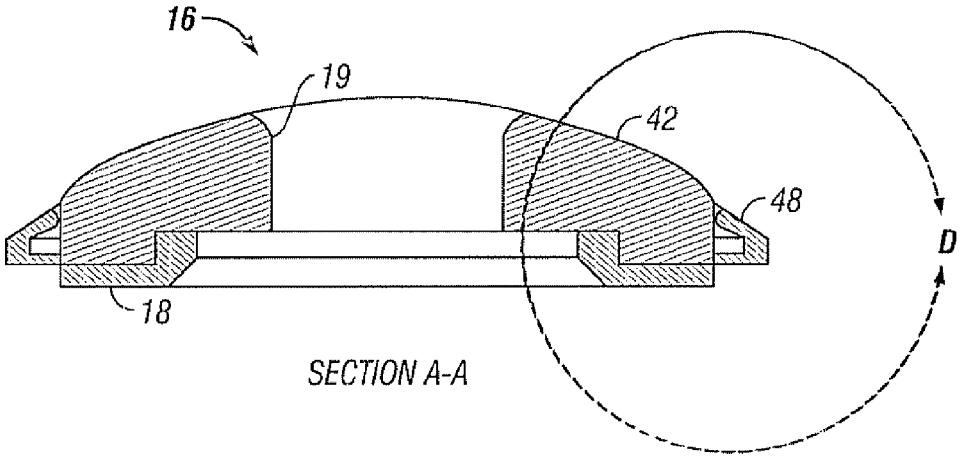
FIG. 5B is a cross-section view of plane A—A of the seal pad shown in FIG. 5.
Figure 5C:
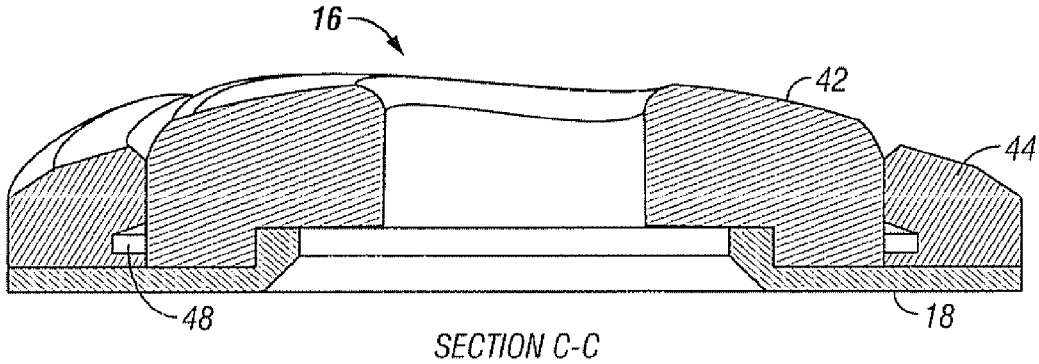
FIG. 5C is a cross-section view of plane C—C of the seal pad shown in FIG. 5.
Figure 5D:
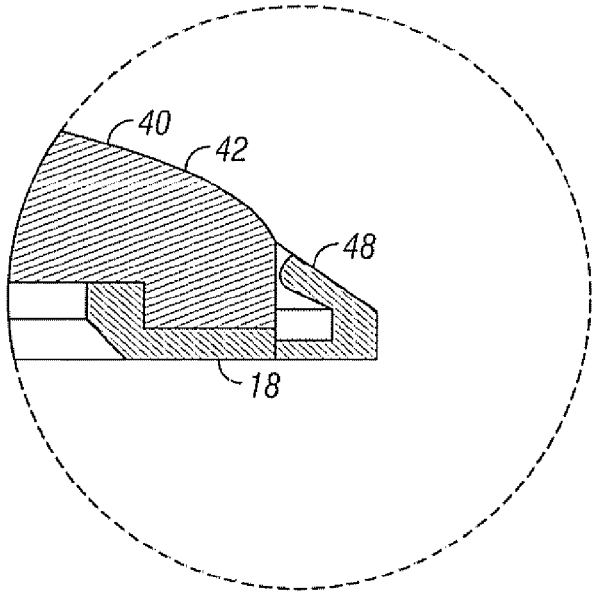
FIG. 5D is a detailed view of the section "D" of FIG. 5B.
Figure 6:
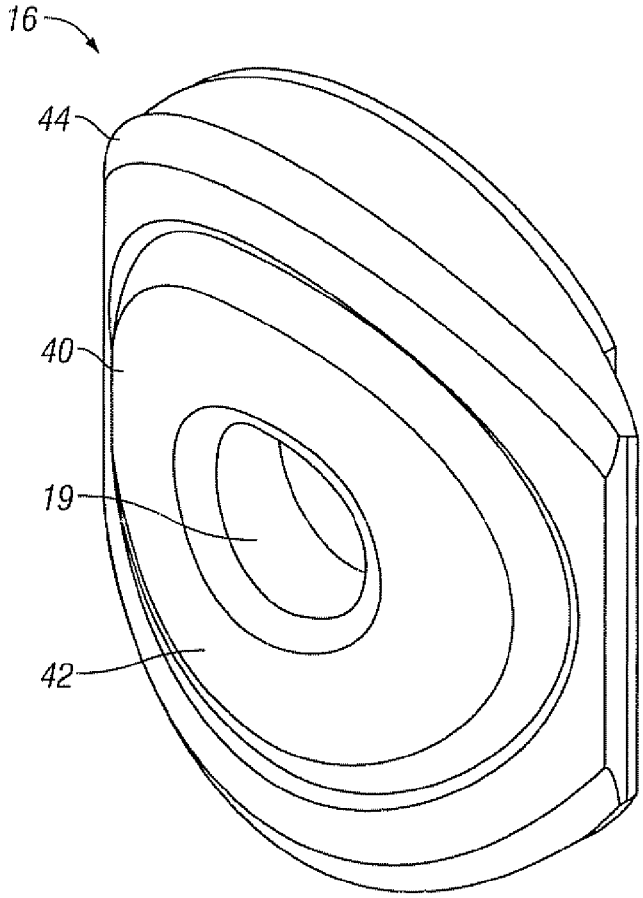
FIG. 6 is a perspective view of the seal pad shown in FIG. 5.

As shown in FIGS. 5–5D, the retainer surface 46 and the expansion cavity 48 do not both surround the perimeter of the expandable material. However, any suitable configuration of either the retainer surface 46 or the expansion cavity 48 used together or individually may be used. For example, as illustrated in FIGS. 8 and 8B, the retainer 44 may retain the expandable material with a surface 46 around the entire perimeter of the expandable material in a lateral plane of expansion of the expandable material when sealed against the borehole wall. Additionally, as shown in FIGS. 3, 4, 4A, and 5–5D, the retainer 44 is separate from the base plate 18. However, the retainer 44 may also be integral with the base pate 18 and thus not be a separate piece. The retainer 44 also need not surround the entire perimeter of the expandable material 40, but need only surround a portion of the expandable material 40 to control as much expansion as desired.

Once the extendable test probe assembly 14 is in its extended position and a seal formed against the wall of the borehole 20, a sample of formation fluid can be acquired by drawing in formation fluid through the bore 19 of the expandable material and base plate and into the axial central bore 32 of the cylinder 17. As shown in FIGS. 4 and 4A, the fluid is drawn in the cylinder 17, through the fluid sample conduit 30, and into the fluid sample chamber 31. The sample fluid may be drawn in using a fluid pump 50. The fluid may also be drawn by having the fluid sample chamber 31 volume varied by actuating one or more draw-down pistons (not shown), such as are known in the art. In this manner, the pressure in sample conduit 30 can be selectively controlled. The fluid sample may also be drawn into the chamber 31 by any other suitable means. Once a suitable sample has been collected, the extendable test probe assembly 14 can be returned to the retracted position by reducing the pressure within hydraulic conduit 28. The extendable test probe assembly 14 may be retractable by applying positive fluid pressure but may also be retracted using only hydrostatic pressure from the wellbore 20. After the extendable test probe assembly 14 is retracted, drilling operations may again commence. The formation tester 10 may also comprise a sensor (not shown) for sensing at least one characteristic of the formation fluid. The fluid characteristic may include the fluid type or quality, the formation pressure, the hydrocarbon content, or any other desired characteristic. Once the sensor measures the characteristic, the sensor may also transmit a signal indicative of the characteristic or characteristics to the surface through a telemetry system (not shown). The telemetry system may comprise electrical signal conduits in the drill string or wireline, a mud-pulse telemetry system, or any other suitable telemetry system for transmitting a signal to the surface.

Figure 7:
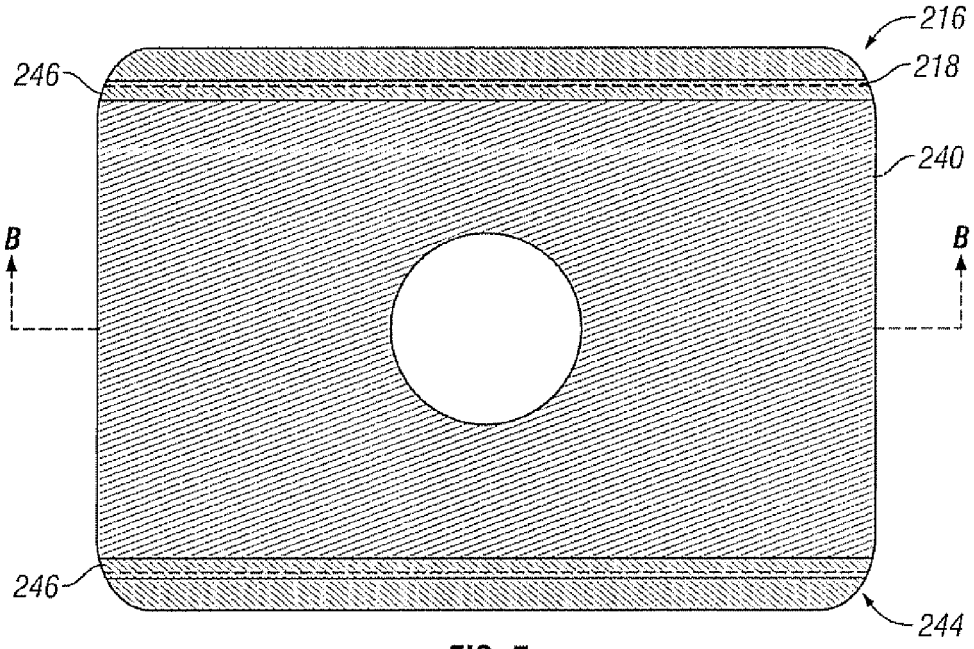
FIG. 7 is a top view of another embodiment of the seal pad of the extendable test probe assembly of the formation tester.
Figure 7A:
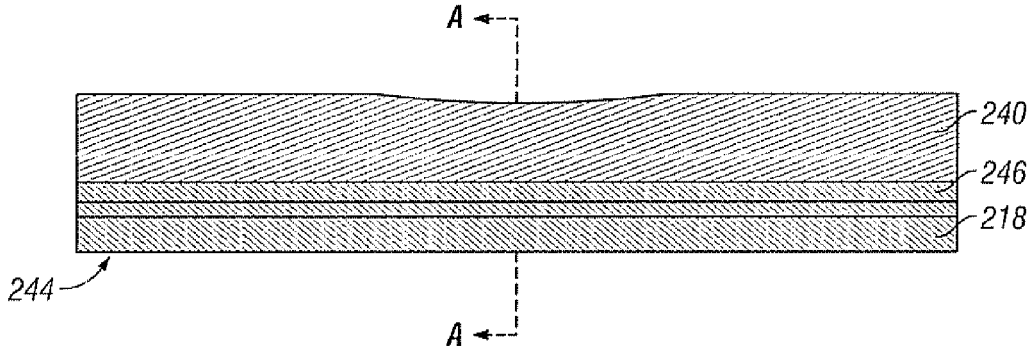
FIG. 7A is a side elevation view of the seal pad shown in FIG. 7.
Figure 7B:
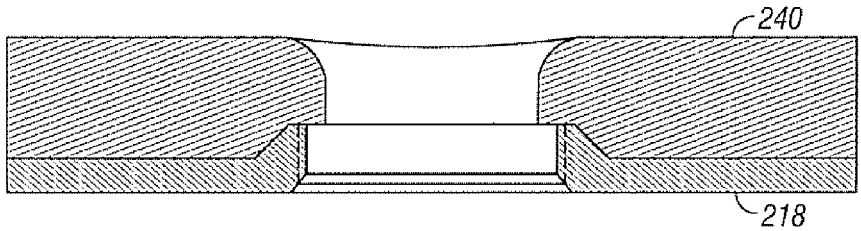
FIG. 7B is a cross-section view of plane B—B of the seal pad shown in FIG. 7.
Figure 7C:
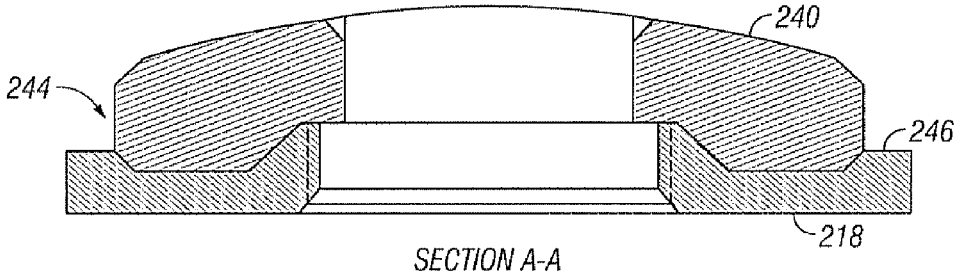
FIG. 7C is a cross-section view of plane A—A of the seal pad shown in FIG. 7A.

Referring now to FIGS. 7–7C, a second embodiment of the seal pad 216 is shown. The operation of the seal pad 216 is similar to the seal pad embodiment 16 described above and some details will not be repeated. The seal pad 216 comprises a base plate 218 and an expandable material 240 engaged with the base plate 218. The expandable material 240 comprises an outer surface 242, a portion of which is engaged with the base plate 218 and a portion of which is used to form a seal against the wall of the borehole (not shown). The seal pad base pate 218 also comprises a retainer 244 comprising raised ribs 246 on the outer perimeter of the expandable material 240. As the expandable material 240 is pressed against the wall of the wellbore, a portion of the expandable material 240 expands. The raised ribs 246 control the expansion of the expandable material 240 by engaging a portion of the expandable material 240 as the expandable material 240 forms a seal with the wall of the wellbore.

FIGS. 7–7C show two ribs 246 on opposite sides of the base plate 218. There may also be only one rib 246 along one side of the base plate 218. There may also be ribs 246 along all of the sides of the base plate 218. The ribs 246 may also be any desired height for controlling the expansion of the expandable material 240.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A seal pad for sealing against a borehole wall comprising:

a base plate;

an expandable material engaged with the base plate; and a retainer configured to retain at least a portion of the expandable material that is expanded when sealed against the borehole wall in a lateral plane of expansion of the expandable material.

2. The seal pad of claim 1 where the retainer is configured to laterally retain the entire perimeter of the expandable material in a lateral plane of expansion of the expandable material when sealed against the borehole wall.

3. The seal pad of claim 1 where the retainer further comprises an expansion cavity, at least a portion of the expandable material being expanded into the cavity when sealed against the borehole wall.

4. The seal pad of claim 3 where the expansion cavity is located around the entire perimeter of the expandable material in a lateral plane of expansion of the expandable material when sealed against the borehole wall.

5. The seal pad of claim 1 where the retainer is integrated with the base plate.

6. The seal pad of claim 5 where the retainer comprises a rib on at least a portion of the base plate.

7. The seal pad of claim 1 where the retainer comprises a surface around the entire perimeter of the expandable material in a lateral plane of expansion of the expandable material when sealed against the borehole wall.

8. The seal pad of claim 1 where the expandable material comprises an elastomeric material.

9. The seal pad of claim 1 where the expandable material comprises rubber.

10. The seal pad of claim 1 where the expandable material comprises Teflon.

11. A method of forming a seal against a borehole wall comprising:

sealingly engaging the borehole wall with at least a portion of an expandable material engaged with a base plate, at least a portion of the expandable material expanding during engagement of the borehole wall; and retaining the expansion of at least a portion of the expandable material in a lateral plane of expansion with a retainer.

12. The method of claim 11 further comprising retaining the entire perimeter of the expandable material in a lateral plane of expansion with the retainer.

13. The method of claim 11 further comprising expanding at least a portion of the expandable material into a retainer expansion cavity when engaging the borehole wall.

14. The method of claim 13 further comprising expanding the expandable material into the expansion cavity around the entire perimeter of the expandable material in a lateral plane of expansion.

15. A formation tester for engaging the wall of a borehole comprising:

a body;

an extendable test probe assembly comprising:

a seal pad comprising:

a base plate;

an expandable material engaged with the base plate a retainer configured to retain at least a portion of the expandable material that is expanded when sealed against the borehole wall in a lateral plane of expansion of the expandable material; and a bore through the base plate and seal pad; and a cylinder comprising a flow path in fluid communication with the formation through the seal pad bore;

a fluid sample collection reservoir in fluid communication with the test probe cylinder flow path; and a fluid transfer device configured to transfer formation fluid through the test probe cylinder flow path and into the fluid sample collection chamber.

16. The formation tester of claim 15 where the retainer is configured to laterally retain the entire perimeter of the expandable material in a lateral plane of expansion of the expandable material when sealed against the borehole wall.

17. The formation tester of claim 15 where the seal pad retainer further comprises an expansion cavity, at least a portion of the expandable material being expanded into the cavity when sealed against the borehole wall.

18. The formation tester of claim 17 where the seal pad expansion cavity is located around the entire perimeter of the expandable material in a lateral plane of expansion of the expandable material when sealed against the borehole wall.

19. The formation tester of claim 15 where the seal pad retainer is integrated with the base plate.

20. The formation tester of claim 19 where the seal pad retainer comprises a rib on at least a portion of the base plate.

21. The formation tester of claim 15 where the seal pad retainer comprises a surface around the entire perimeter of the expandable material in a lateral plane of expansion of the expandable material when sealed against the borehole wall.

22. The formation tester of claim 15 where the seal pad expandable material comprises an elastomeric material.

23. The formation tester of claim 15 where the seal pad expandable material comprises rubber.

24. The formation tester of claim 15 where the seal pad expandable material comprises Teflon.

25. The formation tester of claim 15 further comprising a sensor for sensing a characteristic of the formation fluid sample.

26. The formation tester of claim 15 where the body is configured for being lowered into a borehole on a wireline.

27. The formation tester of claim 15 where the body is configured for being lowered into a borehole on a drill string.

28. The formation tester of claim 15 where the fluid transfer device comprises a fluid pump.

29. A method for collecting a formation fluid sample from the wall of a borehole comprising:

inserting a formation tester into the borehole, the formation tester comprising a body;

extending an extendable test probe assembly from the body into sealing contact with the borehole wall, the test probe assembly forming the seal with at least a portion of an expandable material engaged with a base plate, at least a portion of the expandable material expanding during engagement of the borehole wall;

retaining the expansion of at least a portion of the expandable material in a lateral plane of expansion with a retainer;

collecting a formation fluid sample through a test probe assembly cylinder in fluid contact with the formation through a bore in the seal pad, the test probe assembly cylinder comprising a flow path;

transferring the formation fluid sample with a fluid transfer device from the test probe assembly cylinder to a fluid sample collection chamber.

30. The method of claim 29 further comprising retaining the entire perimeter of the expandable material in a lateral plane of expansion with the retainer.

31. The method of claim 29 further comprising expanding at least a portion of the expandable material into a retainer expansion cavity when engaging the borehole wall.

32. The method of claim 31 further comprising expanding the expandable material into the expansion cavity around the entire perimeter of the expandable material in a lateral plane of expansion.

33. The method of claim 29 further comprising analyzing the formation sample for a characteristic of the formation fluid with a sensor.

34. The method of claim 29 further comprising inserting the formation tester into the borehole on a drill string while drilling the borehole.

35. The method of claim 34 further comprising ceasing the drilling while collecting the formation fluid sample, withdrawing the extendable test probe assembly into the formation tester body, and continuing to drill the borehole.

36. The method of claim 29 further comprising inserting the formation tester into the borehole on a wireline tool.

37. The method of claim 29 further comprising transmitting a signal indicating the sensed formation fluid characteristic through a telemetry system to the surface.

38. The method of claim 11 where the expandable material comprises an elastomeric material.

39. The method of claim 11 where the expandable material comprises rubber.

40. The method of claim 11 where the expandable material comprises Teflon.

41. The method of claim 29 where the expandable material comprises an elastomeric material.

42. The method of claim 29 where the expandable material comprises rubber.

43. The method of claim 29 where the expandable material comprises Teflon.

* * * * *